US007045734B2

(12) United States Patent
Yan et al.

(10) Patent No.: US 7,045,734 B2
(45) Date of Patent: May 16, 2006

(54) SPARK INDUCTION POWER CONDITIONER FOR HIGH TENSION PHYSICAL SEPARATORS

(75) Inventors: Eric S. Yan, Orange Park, FL (US); Thomas J. Grey, Jacksonville, FL (US)

(73) Assignee: Outokumpu Oyj, Espoo (FI)

( * ) Notice: Subject to any disclaimer, the term of this patent is extended or adjusted under 35 U.S.C. 154(b) by 122 days.

(21) Appl. No.: 10/718,844

(22) Filed: Nov. 21, 2003

(65) Prior Publication Data

US 2005/0121369 A1 Jun. 9, 2005

(51) Int. Cl.
*B03C 7/01* (2006.01)

(52) U.S. Cl. ..... 209/127.1; 209/128; 209/129; 209/130; 209/131

(58) Field of Classification Search ..... 209/127.1–131
See application file for complete search history.

(56) References Cited

U.S. PATENT DOCUMENTS 3,739,554 A * 6/1973 Whetten et al. ..... 96/54
5,755,333 A * 5/1998 Stencel et al. ..... 209/127.1
6,797,908 B1 * 9/2004 Yan et al. ..... 209/131

* cited by examiner

*Primary Examiner*—Donald P. Walsh
*Assistant Examiner*—Jonathan R Miller
(74) *Attorney, Agent, or Firm*—Arthur G. Yeager

(57) ABSTRACT

A D.C. voltage altering device includes at least one spark induction power conditioner including a first electrode connectable to a high voltage D.C. power source and a second electrode spaced from the first electrode and forming a discharging gap therebetween. The second electrode is connectable to a predetermined section of a physical separator and at least one of the electrodes is selectively positionable for altering spatial distance between same. The power conditioner induces a predetermined large amplitude, high frequency current ripple to the second electrode for creating a fluctuating voltage and fluctuating electrostatic field and maintaining continuous current flow through the gap without reversal of polarity. The spark induction power conditioner further includes a dielectric base for housing the electrodes and a plurality of fastening members threadably positionable through the base and engageable with the electrodes so that the discharging gap between the electrodes can be selectively adjusted.

32 Claims, 20 Drawing Sheets

SPARK INDUCTION POWER CONDITIONER FOR HIGH TENSION PHYSICAL SEPARATORS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to D.C. voltage altering devices and, more particularly, to a spark induction power conditioner attachable between a high voltage D.C. power source and a physical separator for improving separation efficiency thereof.

2. Prior Art

Electrostatic separators are well known in the industry. Such devices are commonly used to separate particulate materials based upon their conductivity. A continuing challenge is to improve the separation efficiency of such electrostatic separators. During the separation process, particulate materials to be separated are passed through a charged field or separation zone. A pair of electrodes define this separation zone, and these electrodes often have opposite electrical polarities brought about by applying a D.C. voltage thereto. Conventional separators may be formed into plates, drums and revolving belts, for example, as disclosed in U.S. patent applications having Ser. Nos. 10/120,017 and 10/376,190, respectively. Such pending patent applications are hereby incorporated by reference.

Magnetic separators employing plates, drums and revolving belts are also conventional in separating ore minerals by their magnetic properties. An improvement has been made recently and a patent application no. 10/700,704 entitled "Magnetic Separator with Electrostatic Enhancement for Fine Dry Particle Separation" was filed on Nov. 4, 2003, which is hereby incorporated by reference.

Conventional D.C. voltage sources have inherent ripple characteristics but such sources tend to be purposefully minimized and such a D.C. power source, with a little ripple, does not provide enhanced separation efficiency when connected to an electrostatic separator. High voltage D.C. power manufacturers design and produce D.C. power sources with lower and lower ripple, and the lower the ripple the more costly the source as a general rule. Unfortunately, no known prior attempts disclose any such D.C. power sources connectable to existing electrostatic separators for improving the separation efficiency thereof. Accordingly, a need remains for a device connectable to a high voltage D.C. power source for improving the separation efficiency of electrostatic separators, which is accomplished according to the present invention.

BRIEF SUMMARY OF THE INVENTION

In view of the foregoing background, it is therefore an object of the present invention to provide a spark induction power conditioner attachable between a high voltage D.C. power source and an electrostatic separator for improving separation efficiency thereof. These and other objects, features, and advantages of the present invention are provided by a D.C. voltage altering device including a first spark induction power conditioner having a first electrode connectable to a high voltage D.C. power source and a second electrode spaced from the first electrode and forming a discharging gap therebetween.

The second electrode is connectable to a predetermined section of an electrostatic separator and at least one of the electrodes is selectively positionable for altering spatial distance between same. The power conditioner induces a predetermined large amplitude, high frequency current ripple to the second electrode for creating a fluctuating voltage and a fluctuating electrostatic field and maintaining current flow continuous through the gap without reversal of polarity.

In a preferred embodiment, the first spark induction power conditioner may be connected in series between a high voltage power source and a corona wire electrode of an electrostatic separator to more effectively pin non-conducting particulate materials on a movable surface, such as a rotating drum or belt, for example. Alternately, the first power conditioner may be connected in series between a high voltage power source and a static lifting electrode of an electrostatic separator to more effectively lift conducting particulate materials from a movable surface such as a curved, neutral plate electrode, a drum or a belt, for example. Furthermore, the first power conditioner may be connected in series between a high voltage power source and a corona wire electrode of an electrostatic separator that is connected in series with a static lifting electrode of an electrostatic separator to more effectively separate non-conducting particulate materials from conducting particulate materials.

In yet an alternate embodiment, the D.C. voltage altering device may include a second spark induction power conditioner spaced from the first spark induction power conditioner. The second power conditioner preferably includes a third electrode connectable to a high voltage D.C. power source and a fourth electrode spaced from the third electrode and forming a discharging gap therebetween. The fourth electrode may be connected to a predetermined section of an electrostatic separator with at least one of the electrodes being selectively positionable for altering spatial distance between same.

Similar to the first power conditioner, the second power conditioner induces a predetermined large amplitude, high frequency current ripple to the fourth electrode for creating a fluctuating voltage and a fluctuating electrostatic field and maintaining continuous current flow through the gap without reversal of polarity. Advantageously, one of the first and second spark induction power conditioners may be connected in series between a high voltage power source and a corona wire electrode of an electrostatic separator and another one of the first and second spark induction power conditioners may be connected in series between a high voltage power source and a static lifting electrode of an electrostatic separator so that the respective fluctuating voltage fields associated with the first and second spark induction conditioners are independently adjustable and not in phase.

Each of the first and second spark induction power conditioners further includes a base having a non-conductive channel formed therein and for housing their respective electrodes, a cover removably positionable on the, base and securable to an electrostatic separator, and a plurality of fastening members selectively engageable with their respective electrodes for maintaining same at selected stable positions.

In triboelectric plate separators, the first spark induction power conditioner may be connected in series between a high voltage power source and a positive plate electrode of the separator to more effectively attract negatively charged particulate materials to a positive plate electrode. Alternately, the first spark induction power conditioner may be connected in series between a high voltage power source and a negative plate electrode to more effectively attract positively charged particulate materials to a negative plate electrode. In triboelectric separators including a plurality of plate electrodes, the first and second spark induction power conditioners may be connected in series between a high voltage power source and a plurality of positive or negative plate electrodes, respectively.

In electrostatic plate separators, the first spark induction power conditioner may be connected in series between a high voltage power source and a lifting electrode of an electrostatic separator.

BRIEF DESCRIPTION OF THE SEVERAL VIEWS OF THE DRAWING

The novel features believed to be characteristic of this invention are set forth with particularity in the appended claims. The Invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1B:
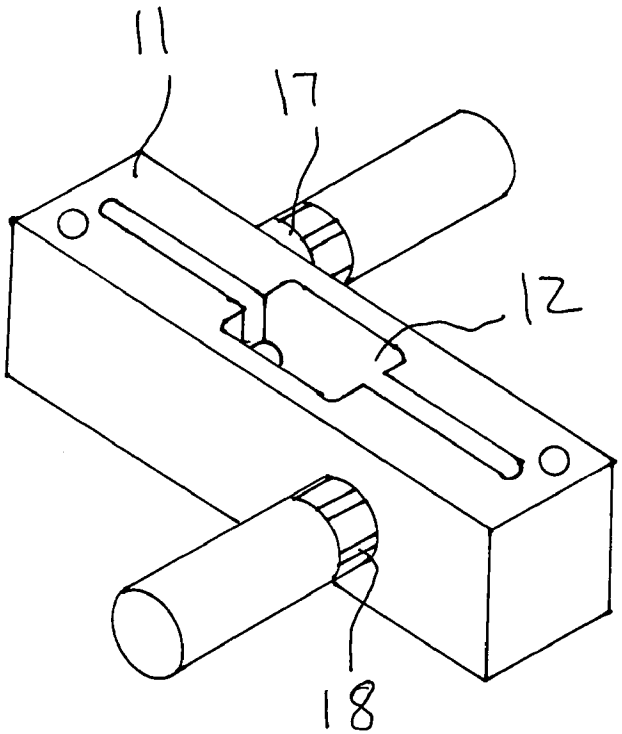
FIGS. 1A and 1B are perspective views showing a spark induction power conditioner with and without a cover secured thereto, respectively, in accordance with the present invention.
Figure 1A:
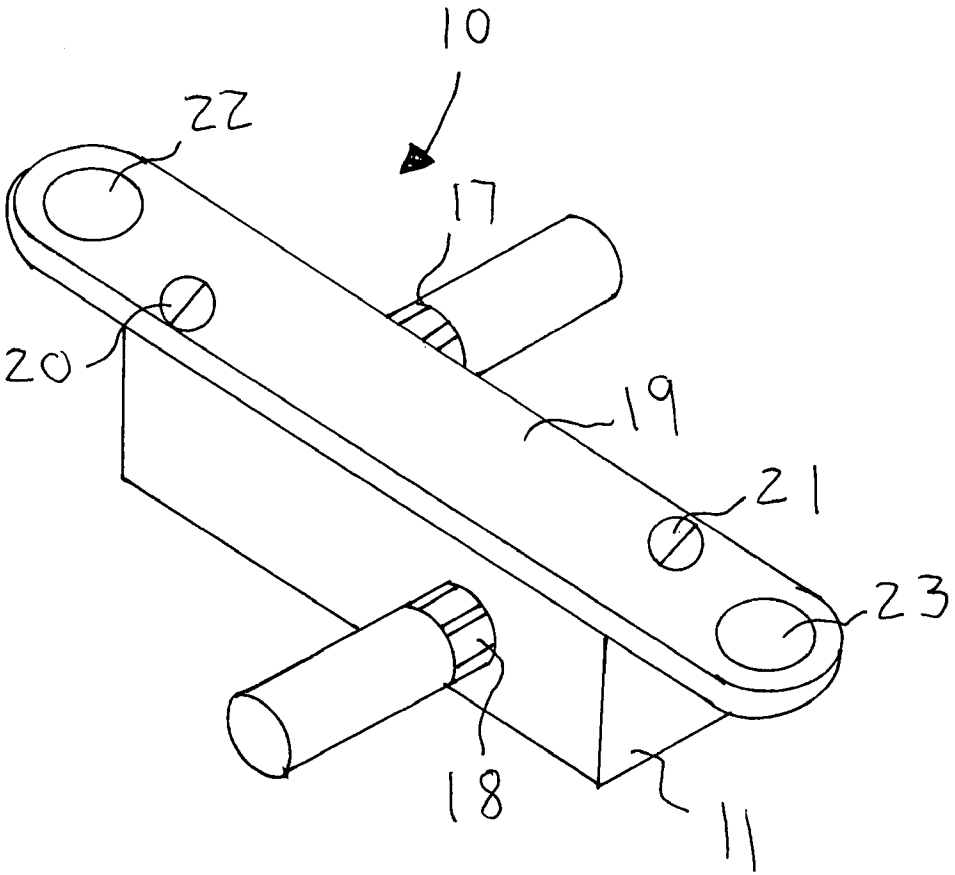
Figure 2:
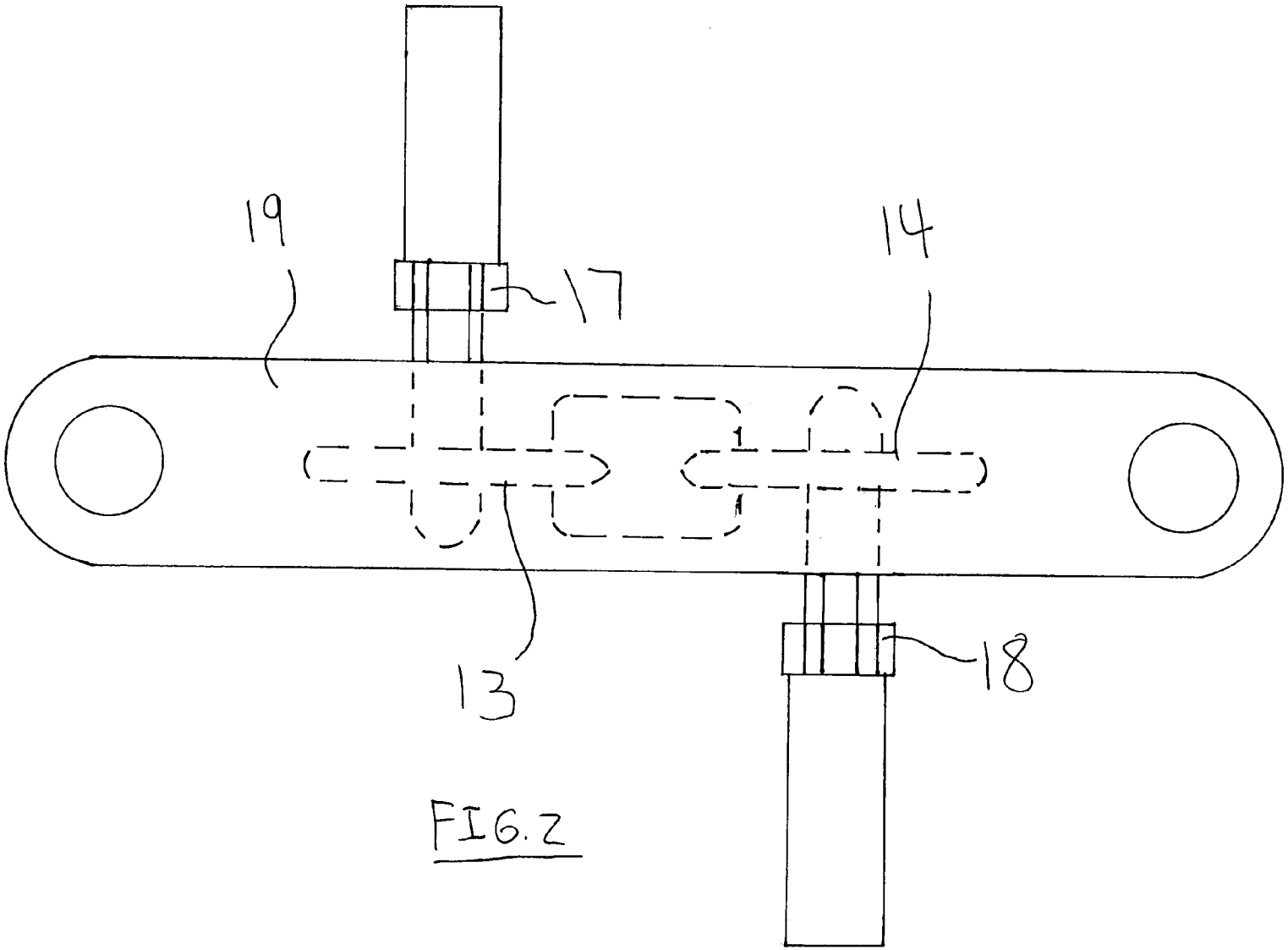
FIG. 2 is a top plan view of FIG. 1A.
Figure 3:
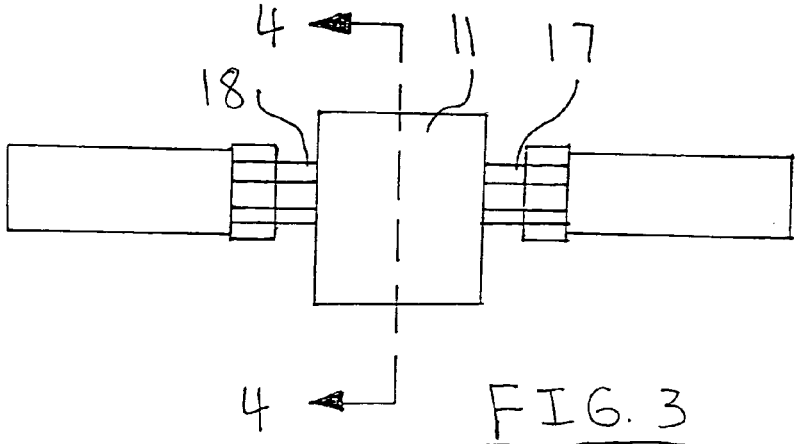
FIG. 3 is an end view of FIG. 1B.
Figure 4:
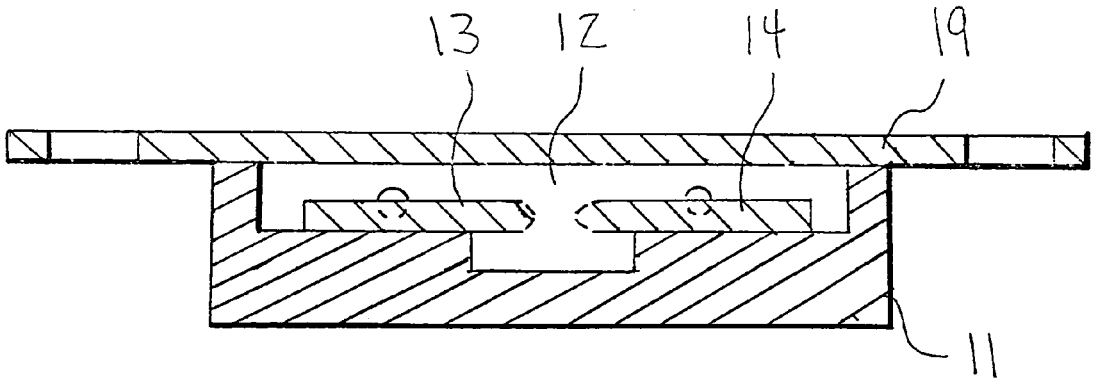
FIG. 4 is an enlarged cross-sectional view of FIG. 3, taken along line 4—4.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements and prime and double prime number refer to similar elements in alternate embodiments.

The device of this invention is referred to generally in FIGS. 1–20 by reference numeral 10 and is intended to provide a D.C. voltage-altering device attachable between a high voltage D.C. power source and an electrostatic separator for improving separation efficiency thereof. It should be understood that the device 10 may be retrofitted as an after market device, which is employable by various conventional electrostatic separators, such as high tension electrostatic separators employing a rotating drum and triboelectric plate separators, as disclosed in U.S. Pat. No. 6,329,623, incorporated herein by reference. As used herein, the phrase physical separators includes the above-noted electrostatic and triboelectric separators and magnetic separators, as well as high voltage separating equipment, i.e., any solid particle separators employing high voltage methods to separate mixtures of solid particles.

Referring initially to FIGS. 1–4, a spark induction power conditioner 10 includes a generally rectangular base 11 formed from dielectric or insulating material, for example. The base 11 has a groove 12 formed therein for receiving positive and negative electrodes 13, 14, respectively. One of such electrodes 13 is connected to a high voltage supply source 15, as perhaps best shown in FIG. 5. The other electrode 14 is selectively spaced from the opposing electrode 13 and can be adjustably positioned adjacent thereto.

Notably, before a spark is created between the electrodes 13, 14, i.e., before the conditioner 10 is attached to the high voltage D.C. supply source 15 (neg. or pos.), one electrode 13 has voltage built up thereon and causes ionization of the air and particles in the air close to the other electrode 14, which creates an ionization cloud that extends closer thereto for inducing a continuous discharging gap 16 between the two electrodes 13, 14 until electrode 13 is disconnected from the high voltage source 15. The current through the gap is continuous and does not fall to zero nor change polarity (like A.C.) nor does the voltage or the fluctuating field thereof.

A pair of fastening members 17, 18, such as screws, are threadably positionable through the base 11 and engageable with the electrodes 13, 14 at a substantially orthogonal direction, respectively. Such fastening members 17, 18 maintain the electrodes 13, 14 at selected stable positions. Advantageously, an operator may adjust the gap between the electrodes 13, 14 by loosening one or both of the fastening members 17, 18 and moving the electrodes 13, 14 closer or further apart from each other. Such a gap is preferably adjustable between 0.25 and 0.50 inches.

The spark induction power conditioner 10 further includes a dielectric cover 19 securable to the top of the base 11 via a pair of fastening members 20, 21, respectively. Such a cover 19 protects the electrodes 13, 14 from the environment and allows an operator to selectively attach the power conditioner to a predetermined location via a pair of conventional fastening members insertable into holes 22, 23, formed at opposite end portions of the cover 19.

During operating conditions, the power conditioner 10 induces a predetermined large amplitude, high frequency current ripple to the second electrode 14 for creating a fluctuating voltage and fluctuating electrostatic field and maintaining current flow continuous through the gap without reversal of polarity. Such a current ripple is an extensive non sine wave ripple, characteristic of a D.C. voltage. The fluctuating electrostatic field adds a "jigging" action to the electrode system. In general, the fluctuating field induces pulsating forces on the specific particles within the bed or field of particulate materials. This has the benefit of freeing trapped particles that would not be freed if the forces were constant.

Figure 5:
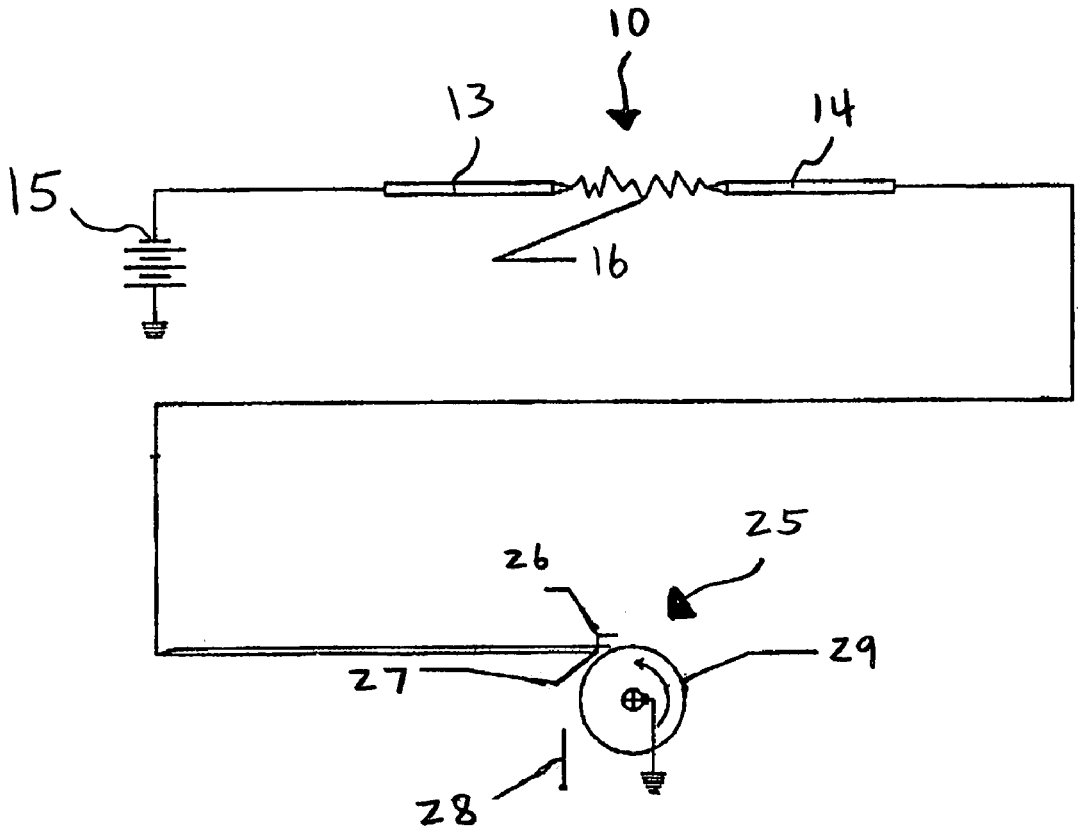
FIG. 5 is a schematic diagram showing a spark induction power conditioner connected to a high-tension electrostatic separator including a corona wire electrode and static lifting electrodes.
Figure 8:
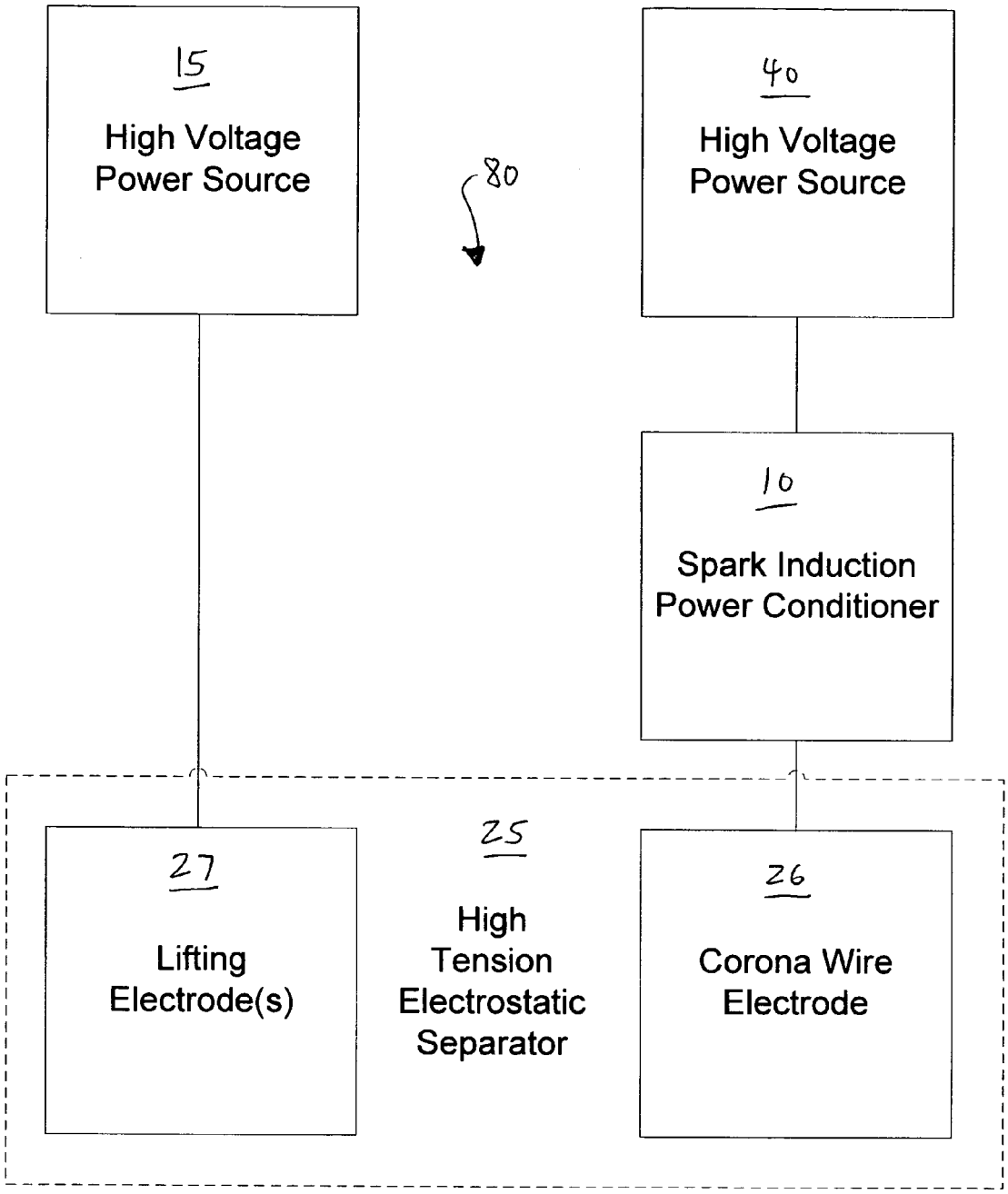
FIGS. 8–11 are schematic block diagrams showing alternate embodiments for connecting at least one spark induction power conditioner to a corona wire electrode and static lifting electrodes of a high-tension electrostatic separator.
Figure 9:
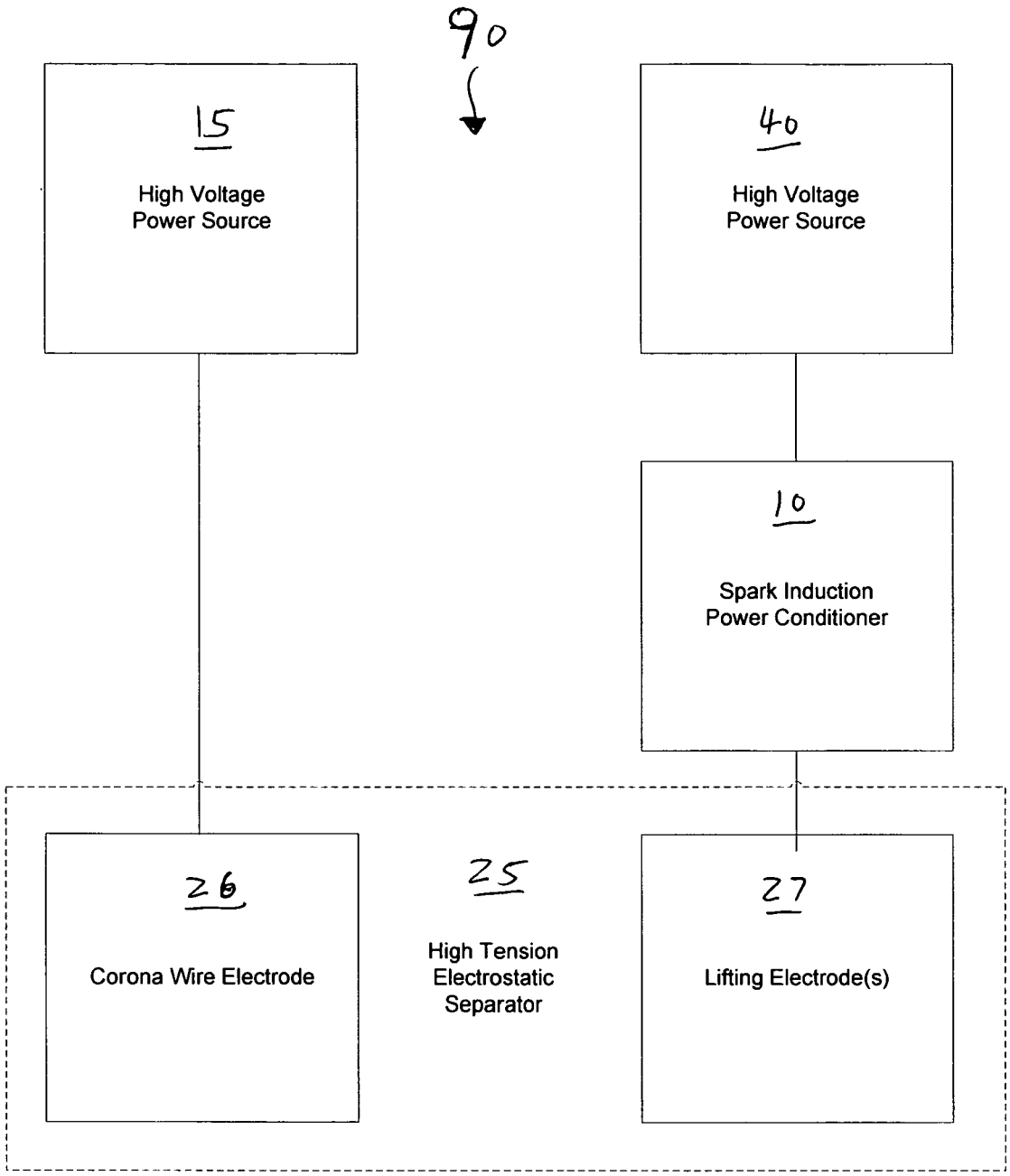
Figure 11:
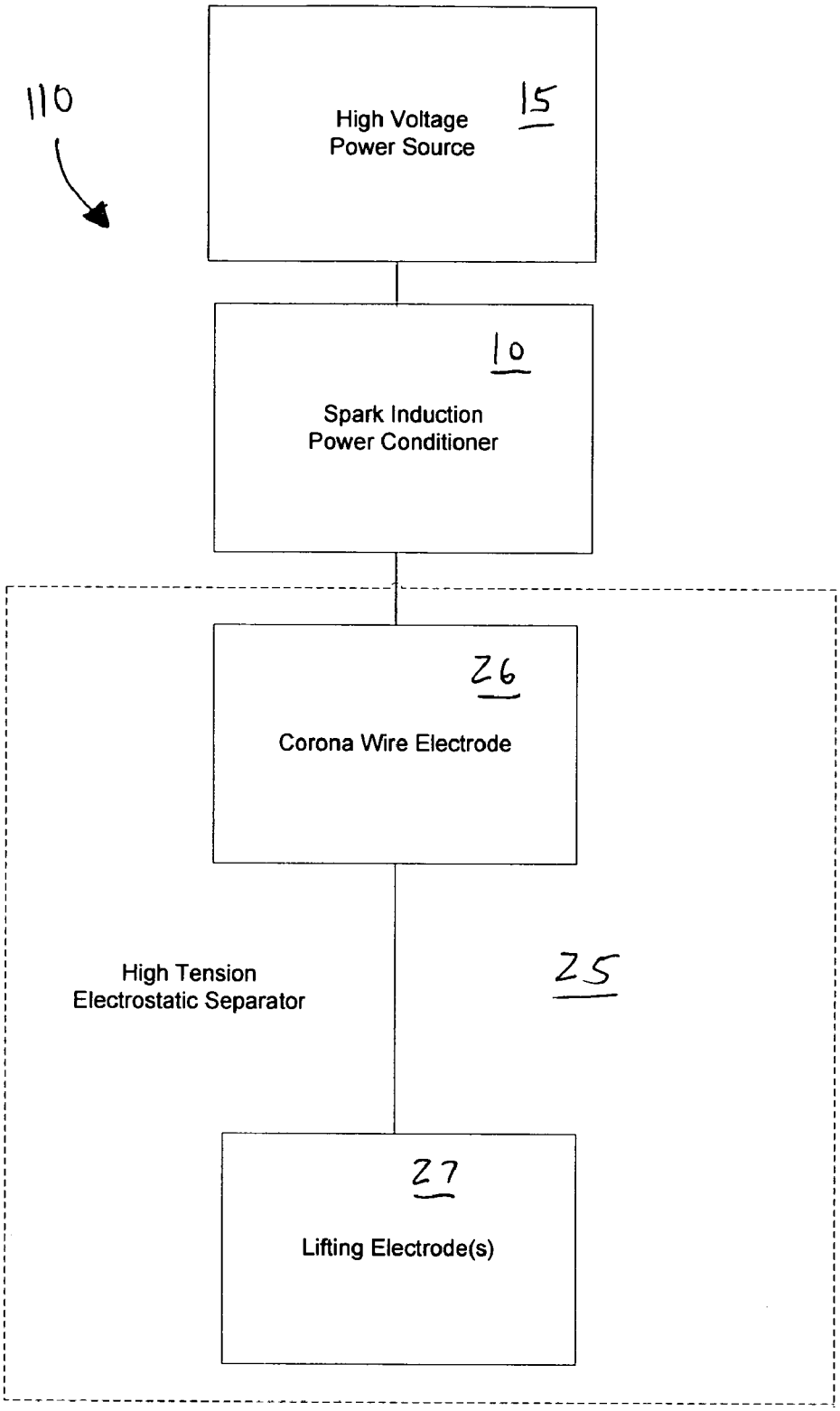
Figure 12:
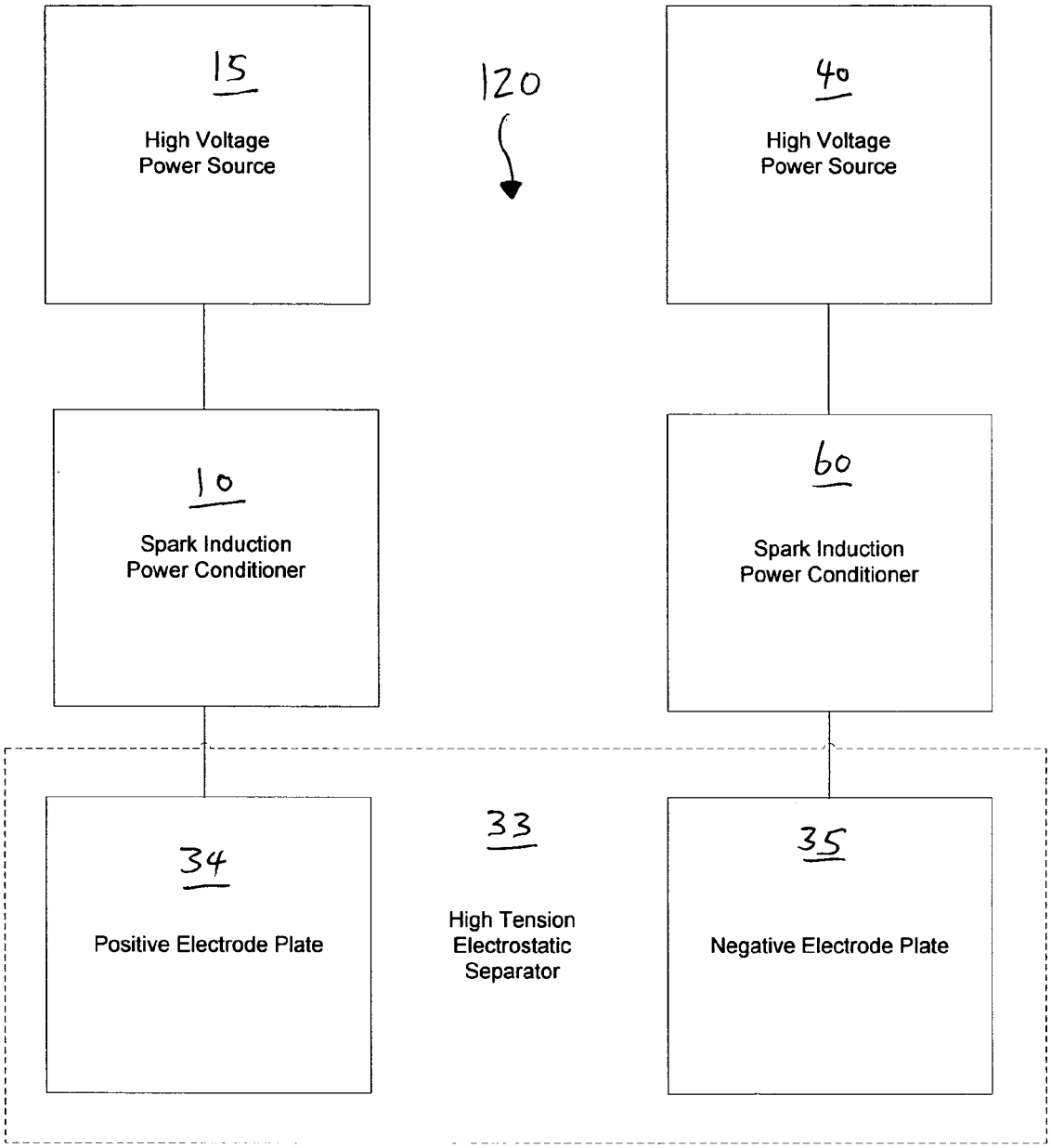
FIGS. 12–16 are schematic block diagrams showing alternate embodiments for connecting at least one spark induction power conditioner to a plurality of plate electrodes commonly employed by a triboelectric plate separator.

In a high-tension electrostatic separator 25, as shown in FIGS. 5 and 8, the power conditioner 10 may be connected in series between a high voltage power source 15 and a corona wire electrode 26 to more effectively pin non-conducting particulate materials on a movable surface such as a rotating drum 29. A conventional splitter 28 may be positioned below the drum 29 for directing the conducting and non-conducting particles towards their respective collection bins (not shown). Alternately, as shown in FIG. 9, the power conditioner 10 may be connected in series between a high voltage power source 15 and a static lifting electrode 27 to more effectively lift conducting particulate materials from a movable surface 29. Furthermore, as shown in FIG. 11, the power conditioner 10 may be connected in series between a high voltage power source 15 and a corona wire electrode 26 that is connected in series with a static lifting electrode 27 to more effectively separate non-conducting particulate materials from conducting particulate materials.

Figure 19:
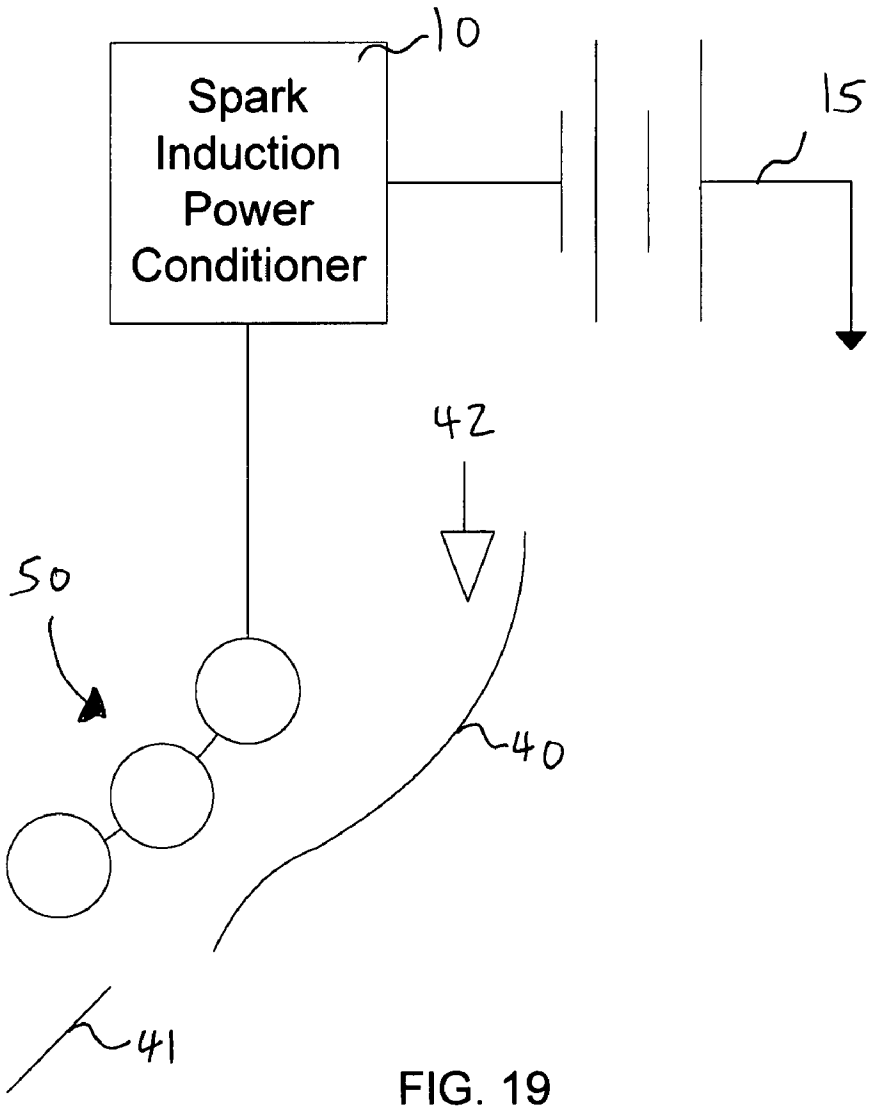
FIG. 19 is a schematic diagram showing a spark induction power conditioner connected to a plurality of static lifting electrodes employable with a grounded, curved plate electrode.

In electrostatic plate separators employing a grounded, curved plate electrode 40 that cooperates with at least one static lifting electrode 50, as perhaps best shown in FIG. 19, the power conditioner 10 may be connected in series between a high voltage power source 15 and the grounded, curved plate electrode 40. In such an embodiment, feed particles 42 are introduced onto the curved plate electrode 40 and travel downwardly thereon wherein the conducting particles are separated from the non-conducting particles and directed towards their respective collection bins (not shown), with the aid of a conventional splitter 41 positioned below the plate electrode 40.

Figure 20:
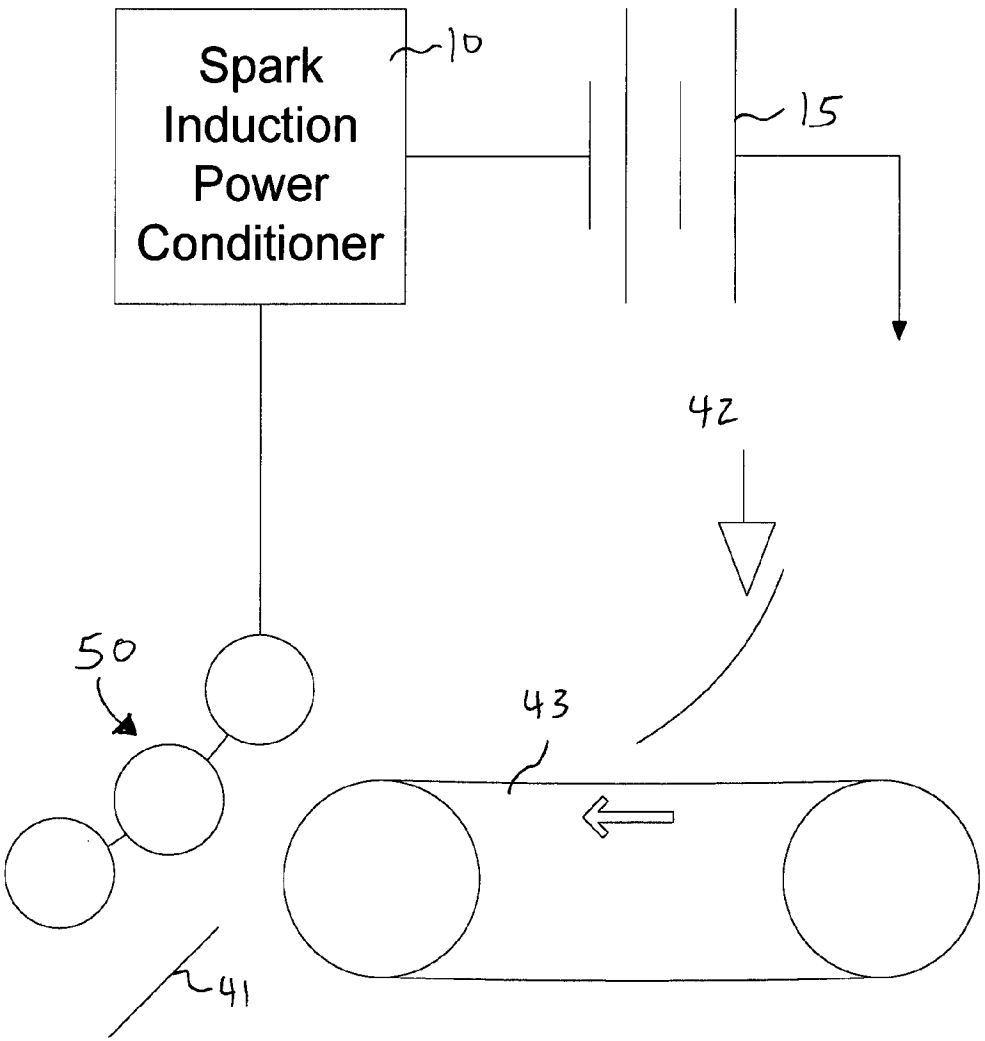
FIG. 20 is a schematic diagram showing a spark induction power conditioner connected to a plurality of static lifting electrodes cooperating with a rotating belt.

Now referring to FIG. 20, an electrostatic separator may include a rotating belt 43 that receives particulate materials 42 from an overhead bin, for example, and directs such materials towards at least one static lifting electrode 50 connected in series to a power conditioner 10. Similar to the embodiment shown in FIG. 19, the power conditioner 10 induces a fluctuating voltage field that more effectively separates the conducting and non-conducting particulate materials with the aide of a conventional splitter 41 (not shown, positioned downstream of the electrodes 50.

Figure 21:
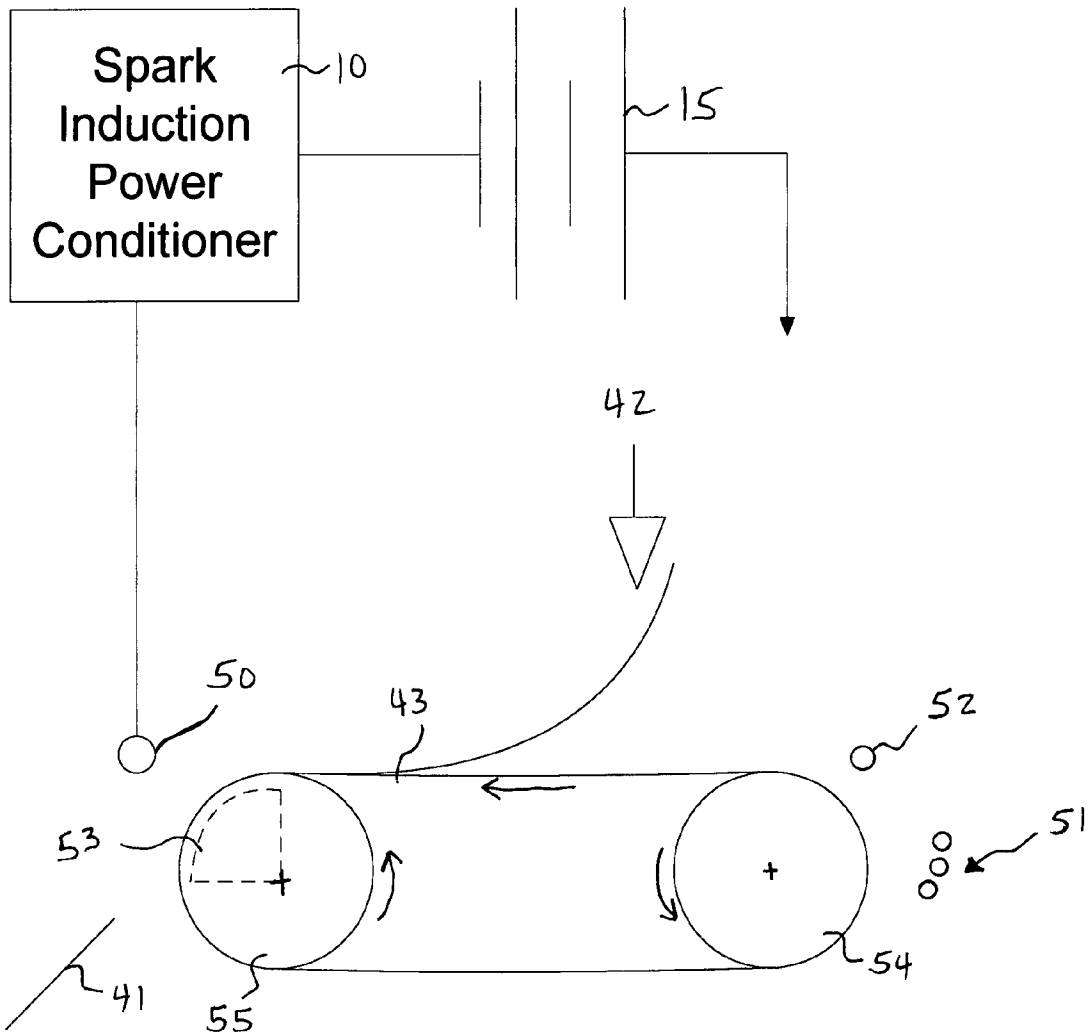
FIG. 21 is a schematic diagram showing a magnetic physical separator employing a spark induction power conditioner, in accordance with the present invention.

FIG. 21 shows a magnetic separator that has been retrofitted with the power conditioner 10 of the present invention. It is well known in the industry that magnetic separators separate magnetic particles from non-magnetic particles via a permanent magnetic array 53. However, such separators often do not effectively remove fine non-magnetic particles from a rotating surface because such particles lack sufficient mass and therefore adhere to the rotating belt due to triboelectrification.

In order to overcome such a shortcoming, an ionizing field can be introduced to the magnetic separator, as disclosed in applicants' pending patent application, referenced above. Furthermore, such a magnetic separator may employ a rotating belt 43, which receives particulate materials 42 from a bin located thereabove. An idler drum 54 and a rotating drum 55 rotate the belt 43. One or more static electrodes 50, 51 and a corona electrode 52 are spaced from the drums 54, 55, as clearly shown in FIG. 21. Such electrodes 50, 51 and 52 may be connected to one or more power conditioners 10, in accordance with the present invention. Of course, it should be understood that the static electrodes 50, 51 and the corona electrode 52 may be connected to one or more power conditioners 10, similar to the configurations shown in FIGS. 8–11, for example, as discussed herein.

Figure 6:
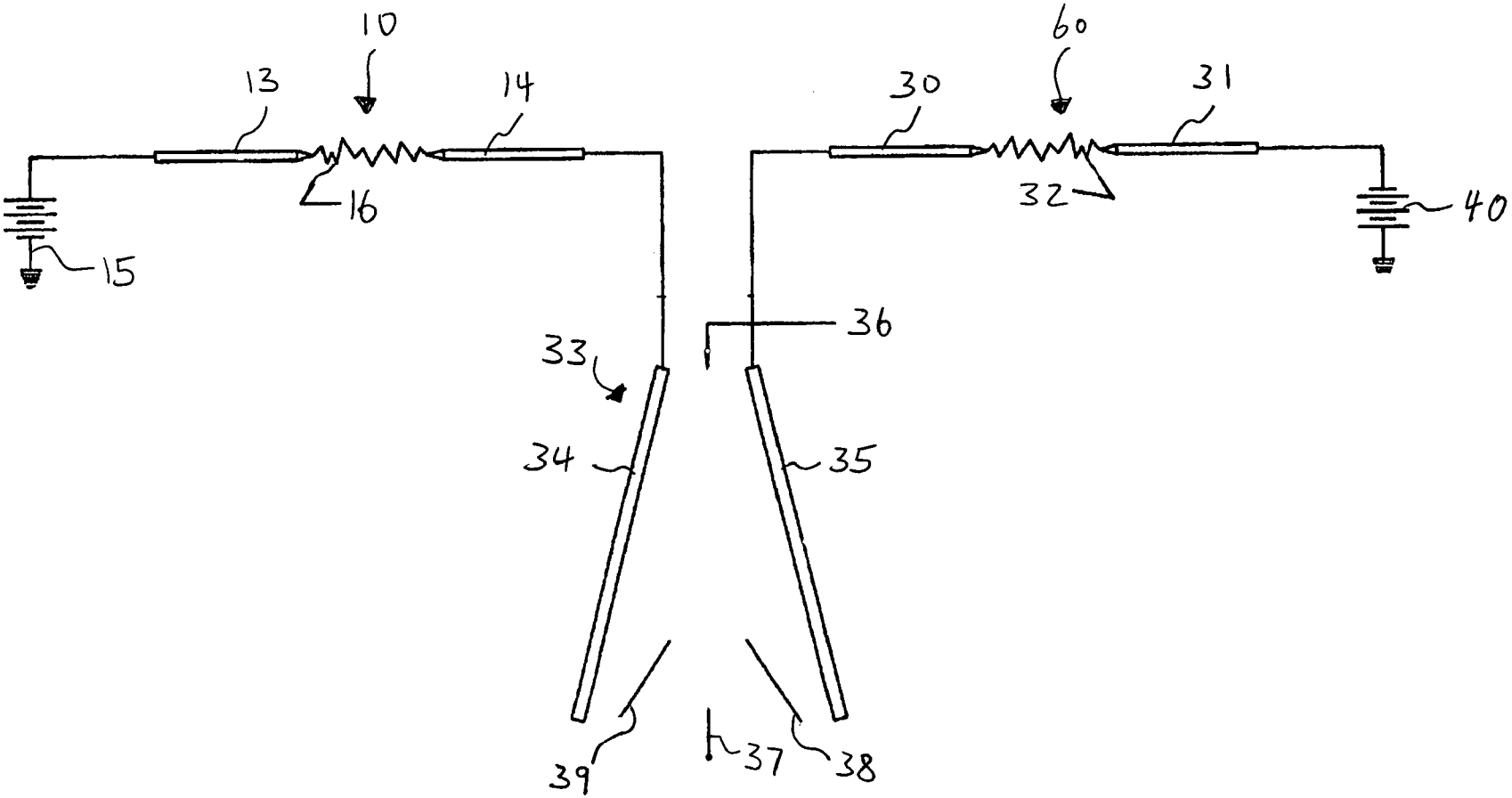
FIG. 6 is a schematic diagram showing a plurality of spark induction power conditioners connected to a plurality of plate electrodes of an electrostatic separator, respectively.
Figure 10:
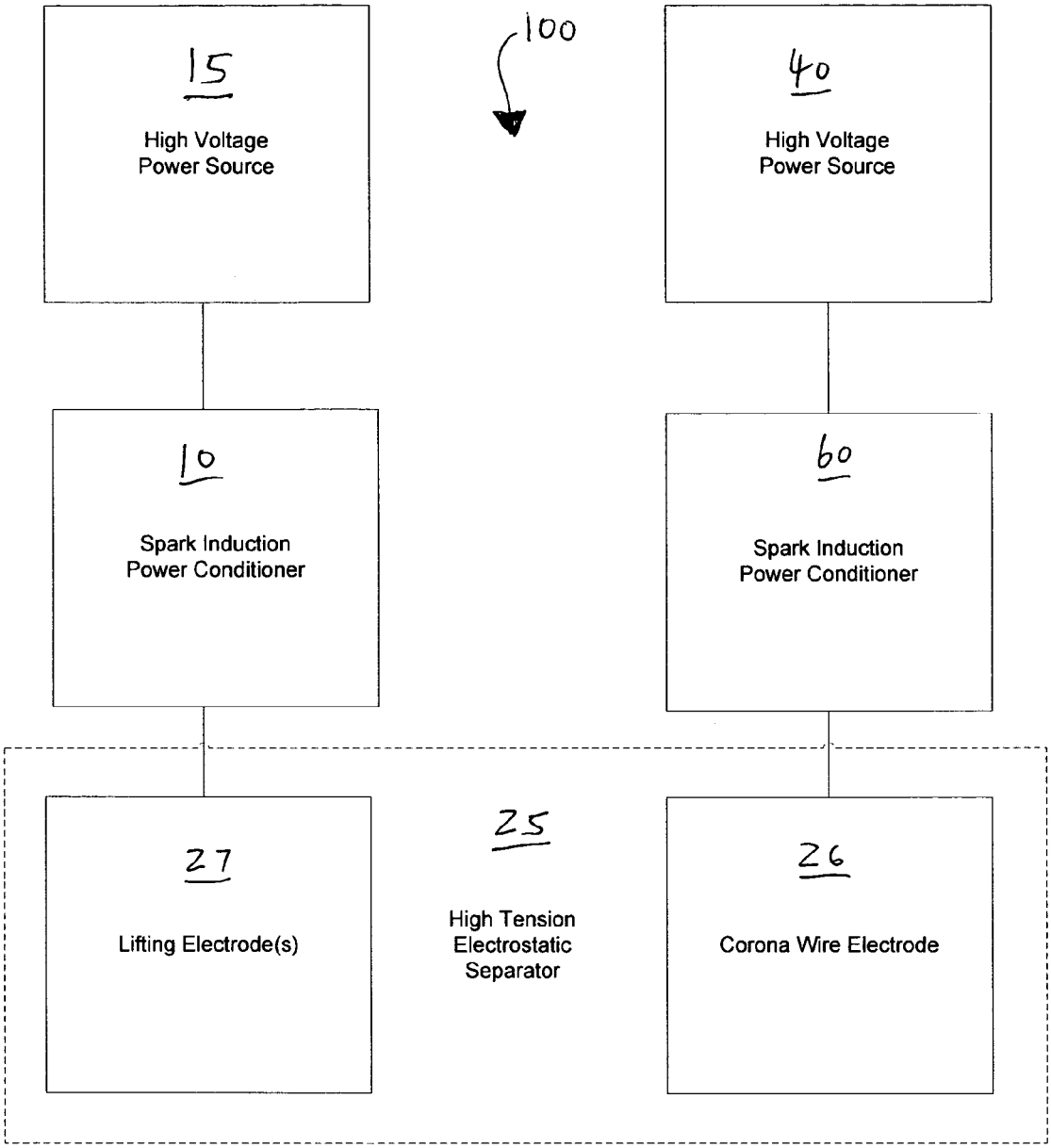

In yet another embodiment, as shown in FIG. 10, the D.C. altering device may include a second spark induction power conditioner 60 spaced from the first spark induction power conditioner 10 and connected in series with a corona wire electrode As perhaps best shown in FIG. 6, such a second power conditioner 60 preferably includes a third electrode 30 connectable to a high voltage D.C. power source 40 and a fourth electrode 31 spaced from the third electrode 30 and forming a discharging gap therebetween. The fourth electrode 31 may be connected to a predetermined section of an electrostatic separator 25 with at least one of the electrodes 30, 31 being selectively positionable for altering spatial distance between same.

Similar to the first power conditioner 10, the second power conditioner 60 induces a predetermined large amplitude, high frequency current ripple to the fourth electrode 31 for creating a fluctuating voltage and fluctuating electrostatic field and maintaining continuous current flow through the gap without reversal of polarity. Advantageously, one of the first and second spark induction power conditioners 10, 60, respectively, is connectable in series between a high voltage power source 15 and a corona wire electrode 26 of an electrostatic separator 25 and another one of the first and second spark induction power conditioners 10, 60, respectively, is connectable in series between a high voltage power source 40 and a static lifting electrode 27 of an electrostatic separator 25. The fluctuating voltage fields associated with the first and second spark induction conditioners 10, 60 are independently adjustable and not in phase. Advantageously, an operator may adjust the gap between the electrodes for altering the voltage and electrostatic fields of the power conditioners 10, 60, respectively.

Now referring to FIG. 6 in more detail and to FIGS. 12–16, a triboelectric plate separator 33, as noted above, may employ the present invention. Such a separator 33 includes a plurality of charged plate electrodes 34, 35, for example, as disclosed in applicant's above-referenced pending patent applications. In such a case, the jigging, which is created by power conditioners 10, 60, causes more of the positively charged particles 39 to migrate towards the negative plate electrode 34 and the negatively charged particles 38 to migrate towards the positive plate electrode 35, thereby improving the separation efficiency of the separator 33. Of course, a conventional splitter 37 may be positioned between the plate electrodes 34, 35 for directing the positively and negatively particles 39, 38 towards their respective collection bins (not shown).

Figure 13:
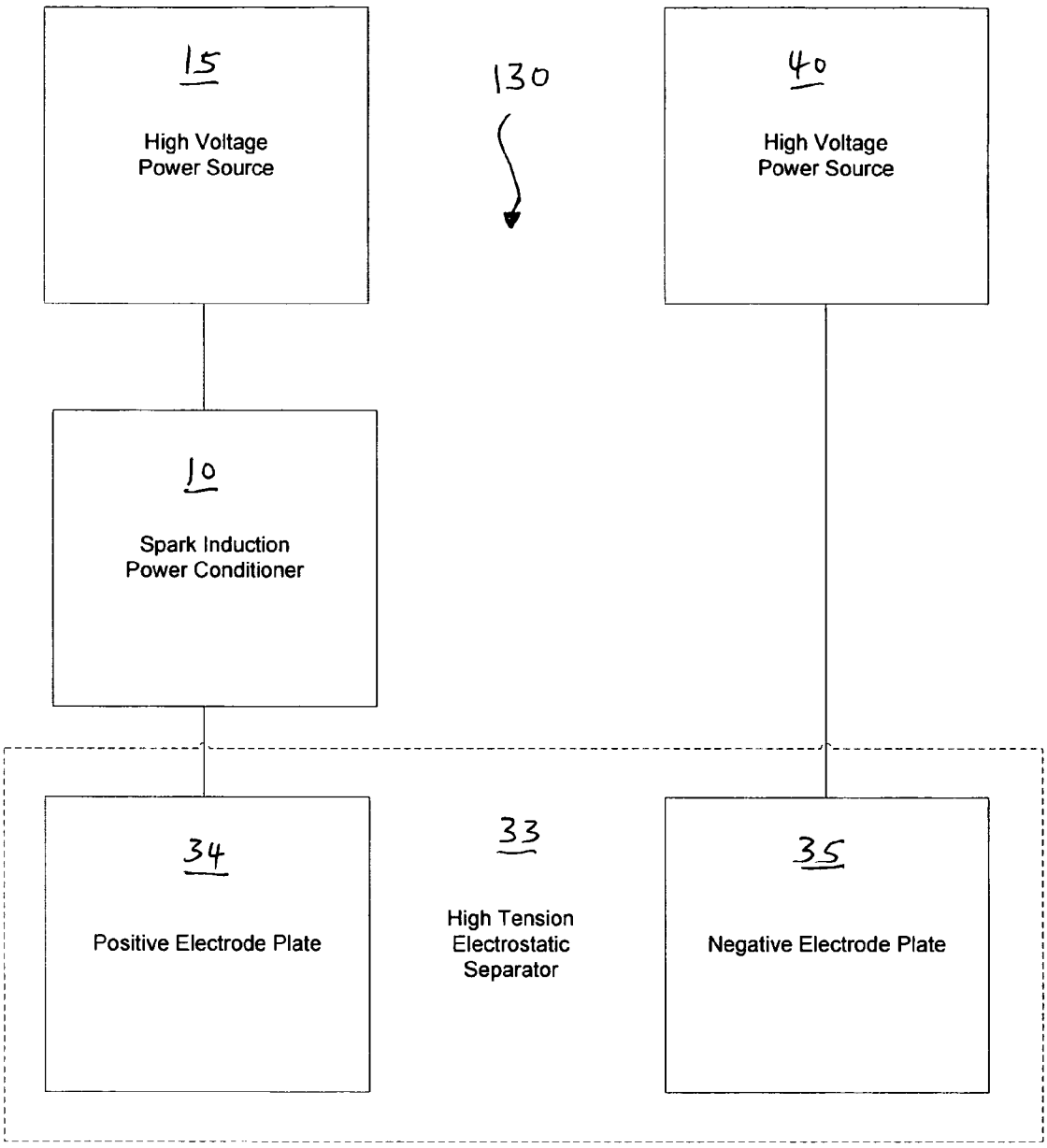
Figure 14:
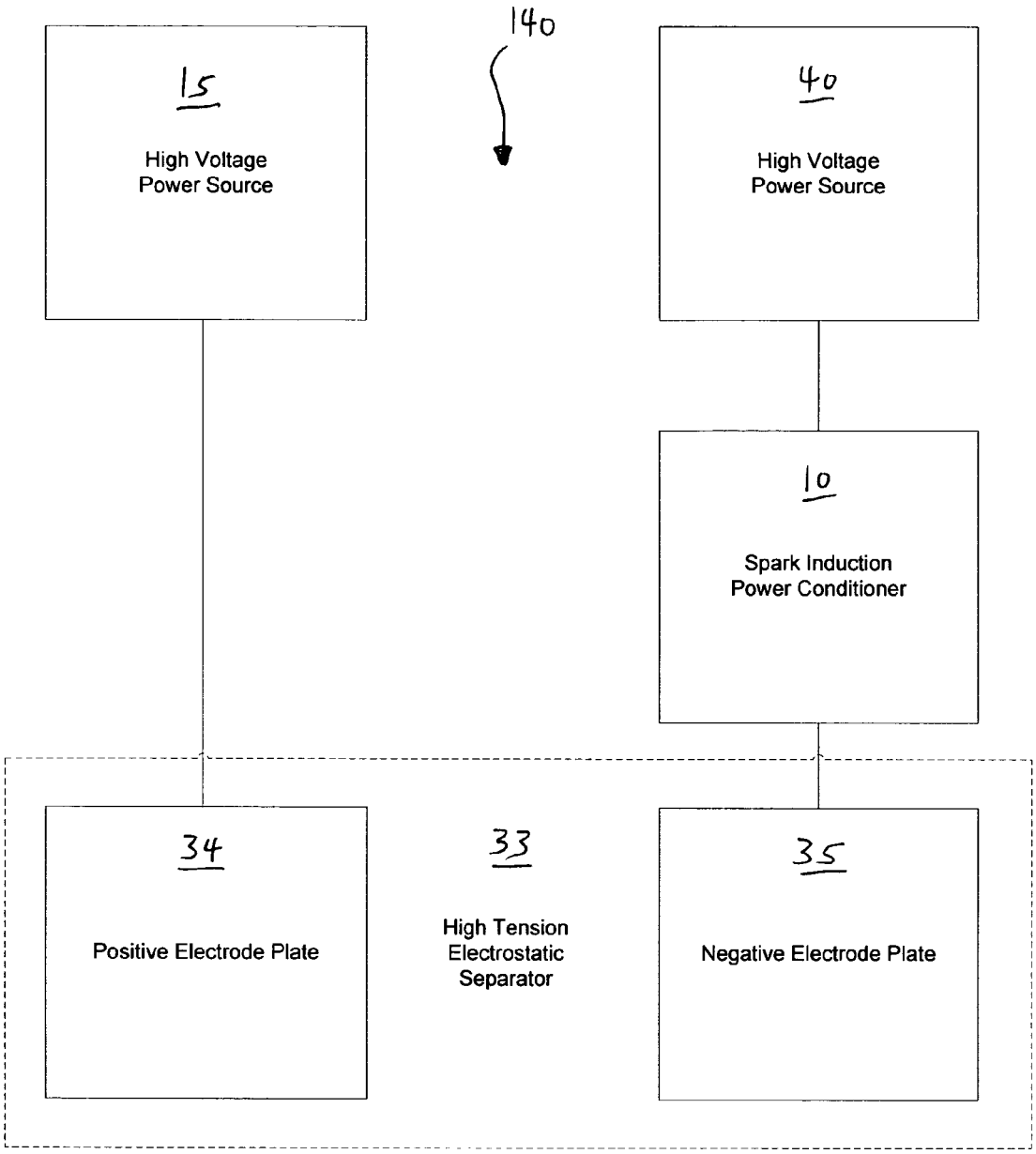

Referring specifically to FIGS. 13 and 14, a first embodiment is shown wherein the first spark induction power conditioner 10 may be connected in series between a high voltage power source 15 and a positive plate electrode 34 of the separator 33 to more effectively attract negatively charged particulate 38 materials to the positive plate electrode 34. In an alternate embodiment, the first power conditioner 10 may be connected in series between a high voltage power source 40 and a negative plate electrode 35 to more effectively attract positively charged particulate materials 39 to a negative plate electrode 35.

Figure 15:
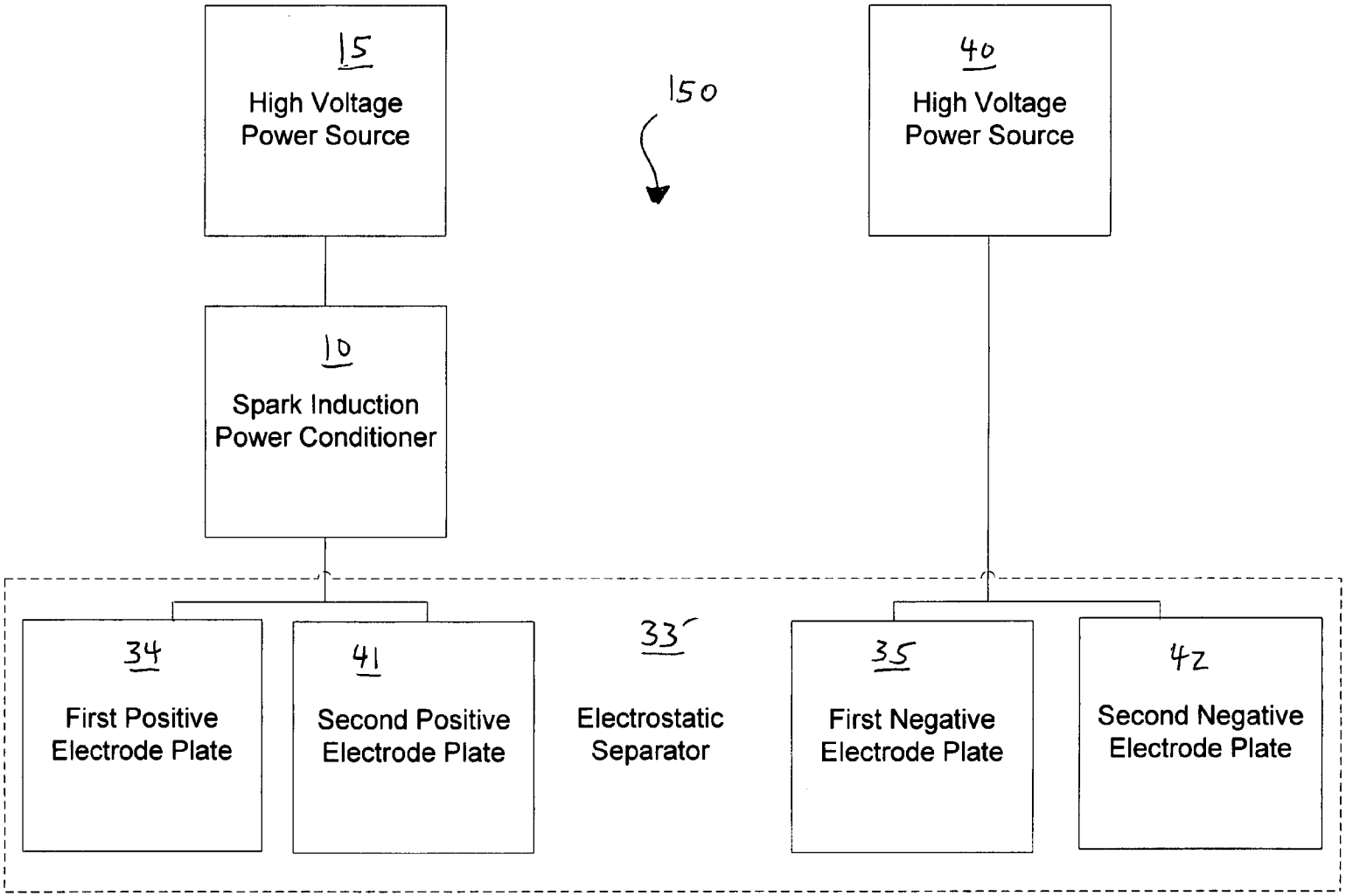
Figure 16:
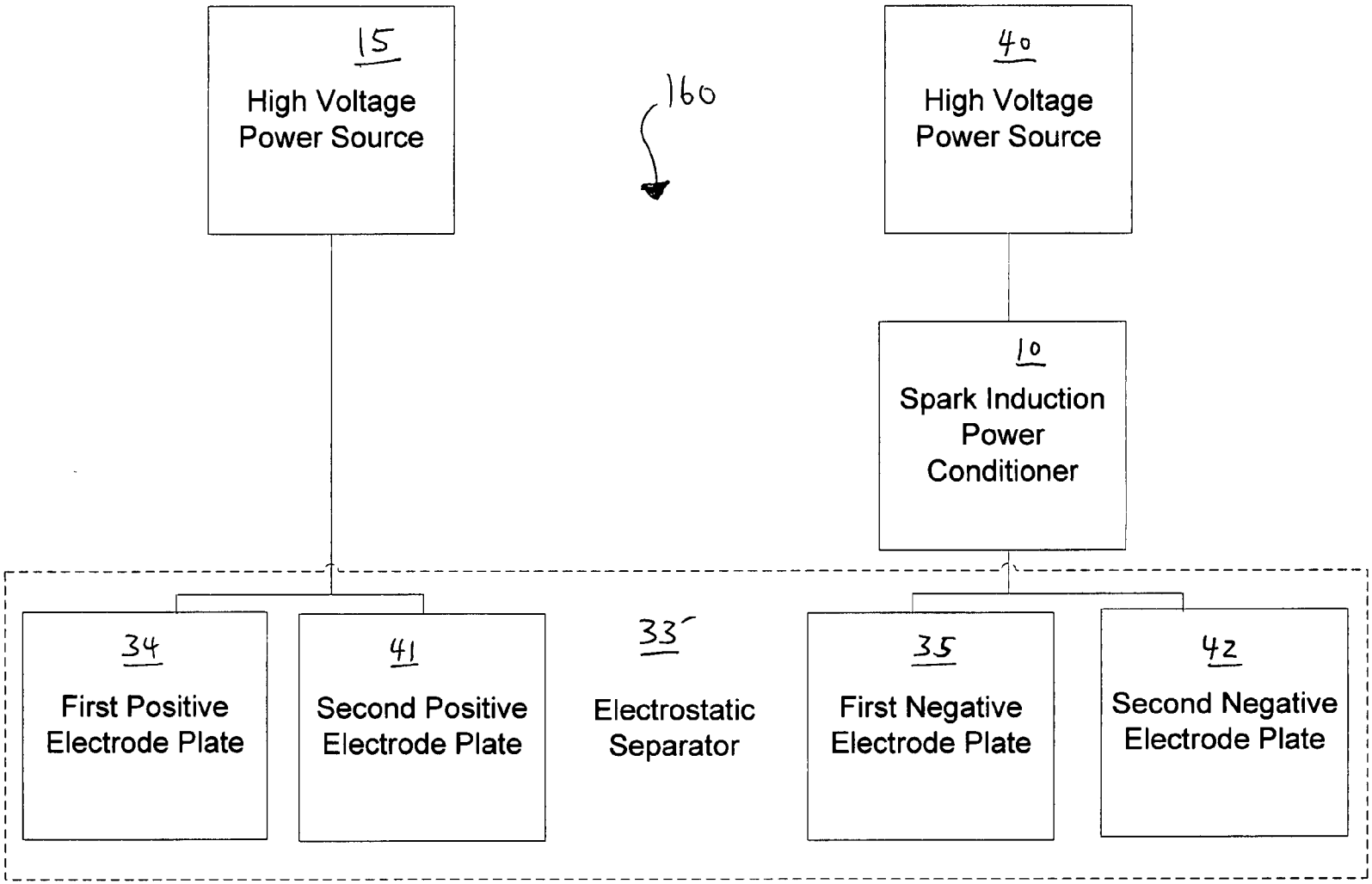

Furthermore, in triboelectric separators 33' that have a plurality of plate electrodes 34, 35, 41, 42, as best shown in FIGS. 15 and 16, a power conditioner 10 may be may be connected in series between a plurality of high voltage power sources 15, 40 and a plurality of positive or negative plate electrodes 34, 41 and 35, 42, respectively. Advantageously, the fluctuating voltage fields associated with the first and second spark induction conditioners 10, 60 are independently adjustable and not in phase.

Figure 7:
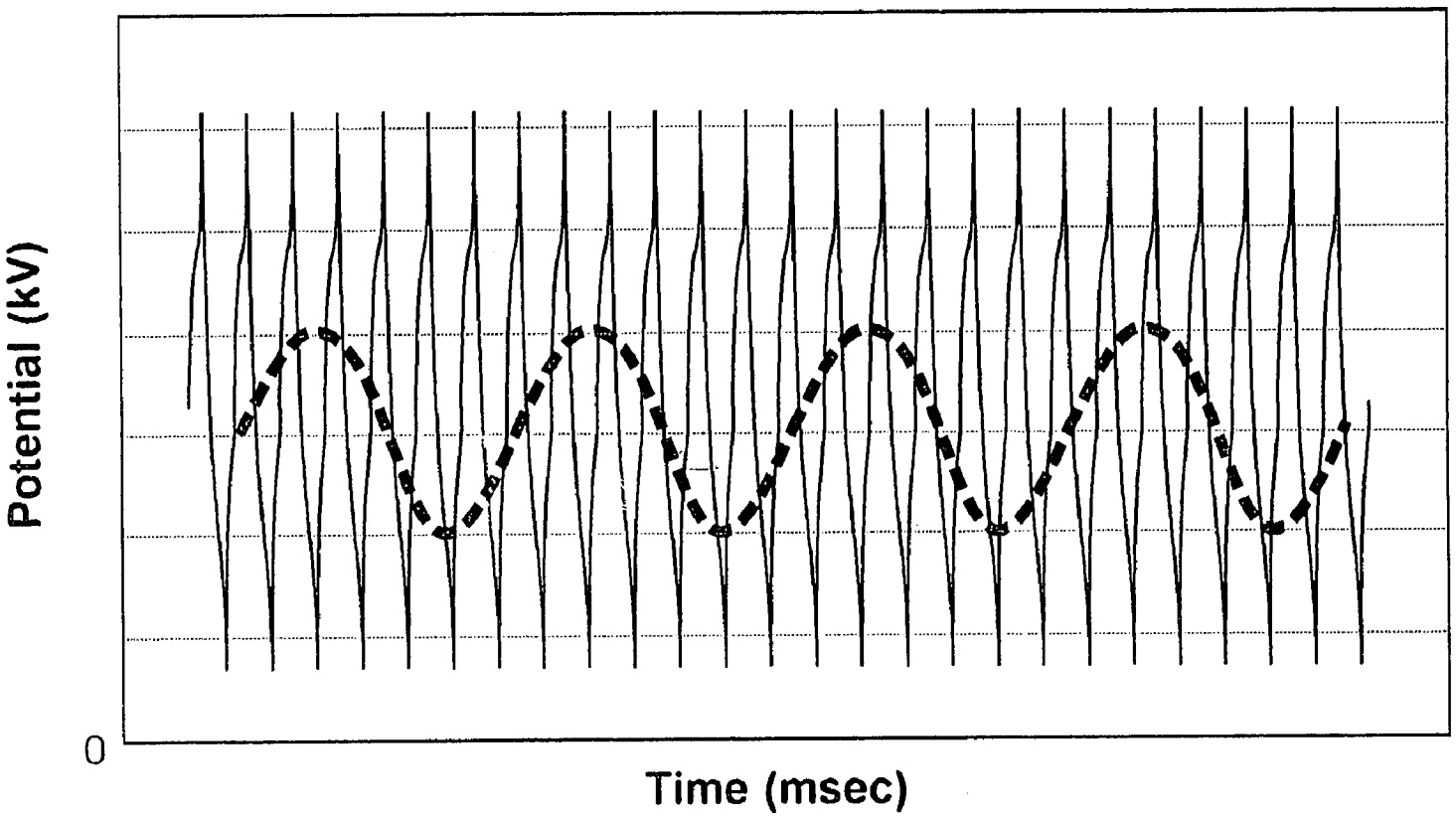
FIG. 7 is a graph comparing a D.C. voltage source potential with and without a spark induction power conditioner attached thereto.
Figure 17:
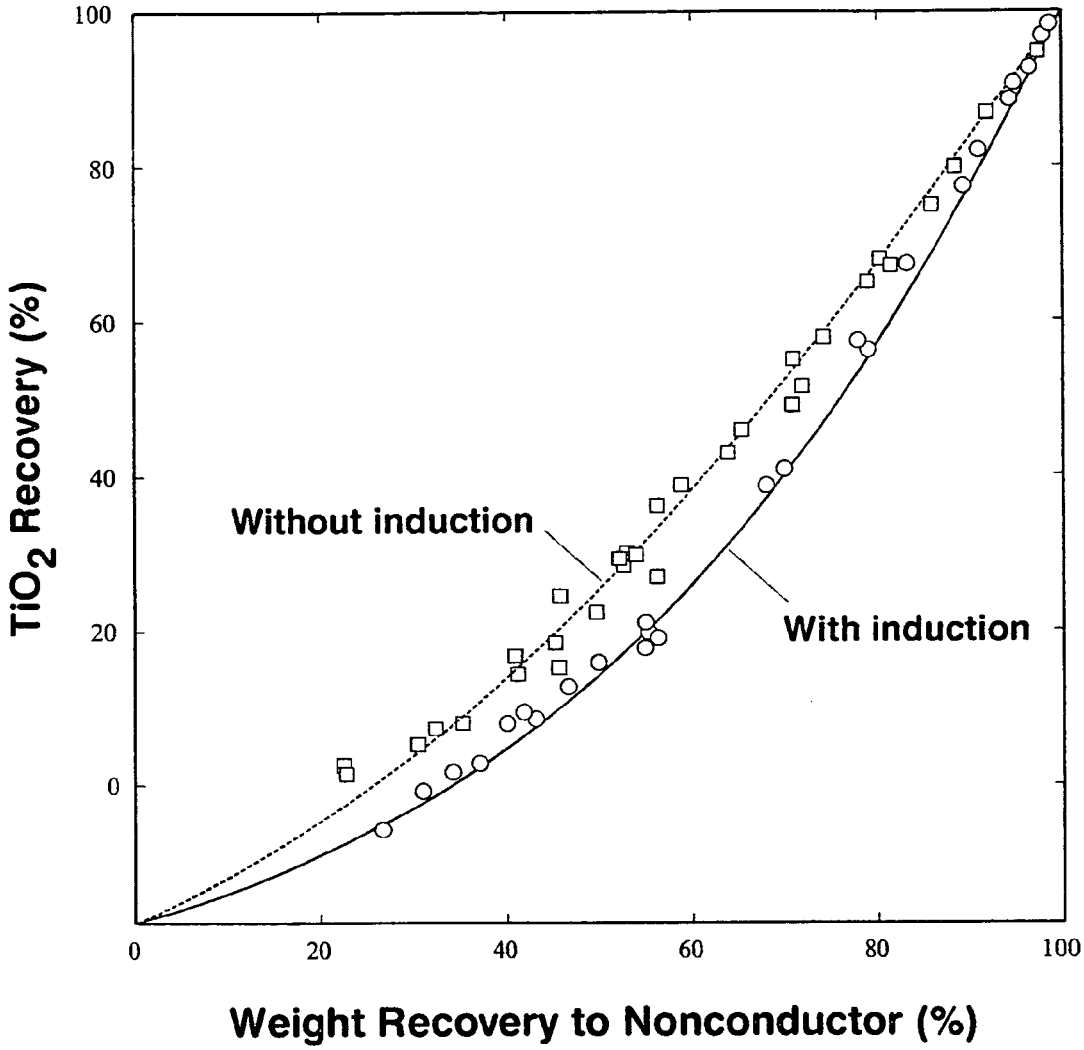
FIGS. 17–18 are graphs showing the $TiO_2$ and $ZrO_2$ recovery per weight recovery of non-conducting particles.
Figure 18:
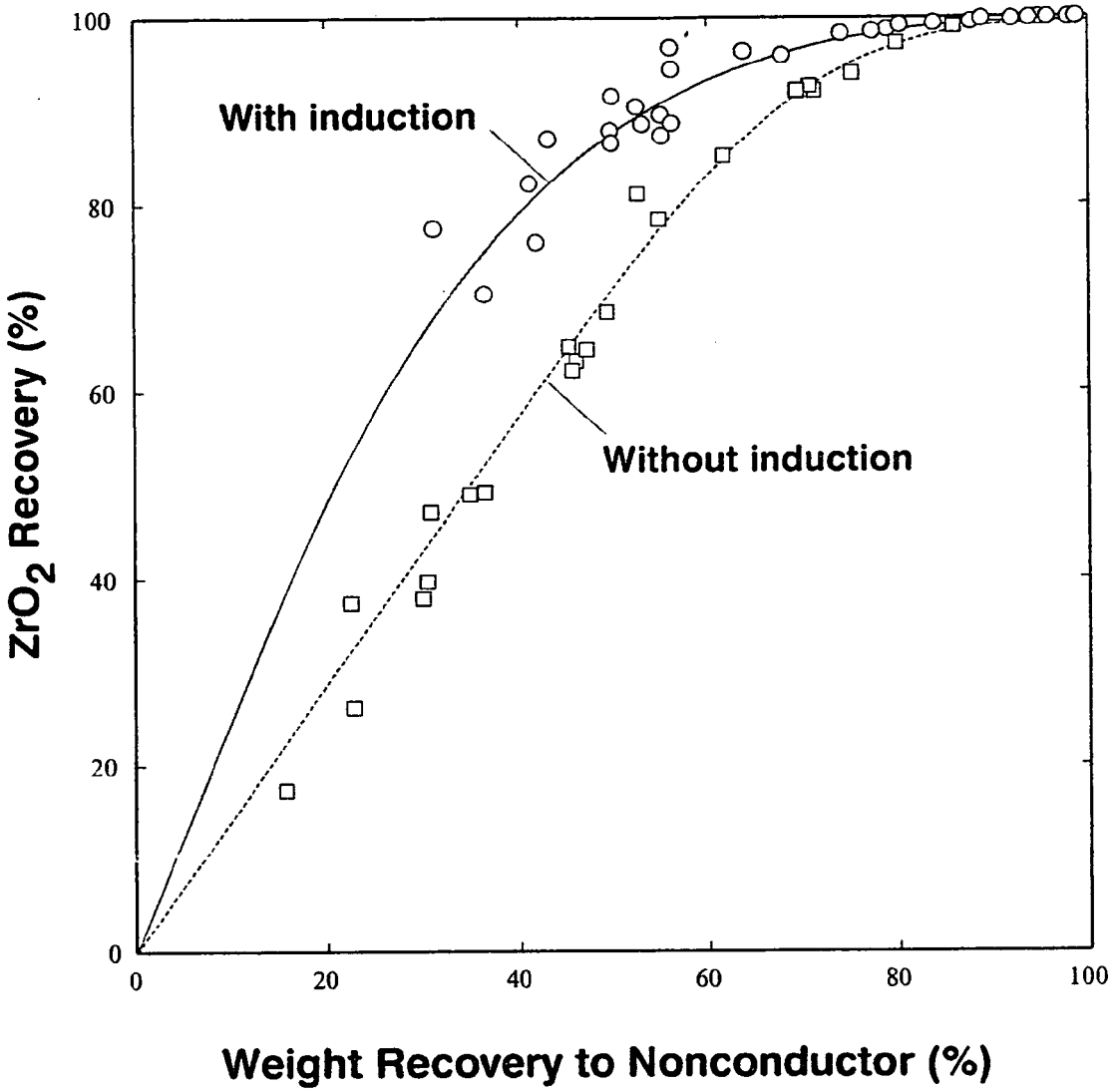

Now referring to FIGS. 17 and 18, the improved separation efficiencies are demonstrated in a pair of graphs, respectively. It is apparent that the separation efficiencies of separating $TiO_2$ from $ZrO_2$ are improved when conventional electrostatic separators employ a spark induction power conditioner, in accordance with the present invention. As shown in FIG. 17, the contamination level of $TiO_2$ particles in the $ZrO_2$ stream was reduced while the $ZrO_2$ recovery was greatly improved, as illustrated in FIG. 18, when a conventional separator employs the power conditioner of the present invention. FIG. 7 illustrates a comparison of the D.C. voltage wave form produced by a industry-standard high voltage power supply source to the wave form produced by the industry-standard high voltage power supply source as modified by the spark induction power conditioner 10 of the present invention.

It is apparent that such a comparison of the wave form, which utilizes the spark induction power conditioner 10, has a higher frequency as well as a greater voltage amplitude in comparison to the standard wave from of the high voltage power supply source. This higher frequency and greater amplitudes are generally known as "noise" and are induced by the discharging gap. When one studies the pattern of the two wave forms, it becomes clear that the wave form produced by the spark induction power conditioner 10 is the standard wave form with a great deal of noise superimposed upon it.

The amount of superimposed noise is controlled by the discharging gap. In particular, with an increase in the spatial distance or gap between the electrodes 13, 14, for example, the superimposed noise and voltage amplitude is increased. Advantageously, because the gap can be selectively adjusted, different conditions can be created for obtaining different effects on the separation efficiency of the different materials.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. In a physical separator having a D.C. voltage altering device attachable between a D.C. high voltage power source and a physical separator for improving separation efficiency thereof, said device comprising:

a first spark induction power conditioner including a first electrode connectable to a high voltage D.C. power source; and a second electrode spaced from said first electrode and forming a discharging gap therebetween, said second electrode being connectable to a predetermined section of a physical separator, at least one of said electrodes being selectively positionable for altering spatial distance between said electrodes;

said power conditioner inducing a predetermined large amplitude, high frequency current ripple to said second electrode for creating a fluctuating voltage and fluctuating electrostatic field and maintaining continuous current flow through said gap without reversal of polarity.

2. The device of claim 1, wherein said first spark induction power conditioner is connectable in series between a high voltage power source and a corona wire electrode of a physical separator to pin non-conducting particulate materials on a movable surface.

3. The device of claim 1, wherein said first spark induction power conditioner is connectable in series between a high voltage power source and a static lifting electrode of a physical separator to lift conducting particulate materials from a movable surface.

4. The device of claim 1, wherein said first spark induction power conditioner is connectable in series between a high voltage power source and a corona wire electrode of a physical separator that is connected in series with a static lifting electrode of a physical separator to separate non-conducting particulate materials from conducting particulate materials.

5. The device of claim 1, further comprising:

a second spark induction power conditioner spaced from said first spark induction power conditioner and including a third electrode connectable to a high voltage D.C. power source; and a fourth electrode spaced from said third electrode and forming a discharging gap therebetween, said fourth electrode being connectable to a predetermined section of physical separator, at least one of said third and fourth electrodes being selectively positionable for altering spatial distance between said third and fourth electrodes;

said second power conditioner inducing a predetermined large amplitude, high frequency current ripple to said fourth electrode for creating a fluctuating voltage and fluctuating electrostatic field and maintaining continuous current flow through said gap without reversal of polarity.

6. The device of claim 5, wherein one of said first and second spark induction power conditioners is connectable in series between a high voltage power source and a corona wire electrode of a physical separator and another one of said first and second spark induction power source and a static lifting electrode of a physical separator, said fluctuating voltage fields associated with said first and second spark induction conditioners being independently adjustable and not in phase.

7. The device of claim 5, wherein said second spark induction power conditioner further comprises:

a base having a channel formed therein and for housing said first and second electrodes;

a cover removably attachable to said base; and a plurality of fastening members selectively engageable with said third and fourth electrodes and for maintaining same at selected stable positions.

8. The device of claim 1, wherein said first spark induction power conditioner further comprises:

a base having a channel formed therein and for housing said first and second electrodes;

a cover removably attachable to said base; and a plurality of fastening members being selectively engageable with said first and second electrodes and for maintaining same at selected stable positions.

9. In a physical separator having a D.C. voltage altering device attachable between a D.C. high voltage power source and a plate of an electrostatic separator for improving separation efficiency thereof, said device comprising:

a first spark induction power conditioner including a first electrode connectable to a high voltage D.C. power source; and a second electrode spaced from said first electrode and forming a discharging gap therebetween, said second electrode being connectable to a plate electrode of a physical separator, at least one of said electrodes being selectively positionable for altering spatial distance between said electrodes;

said power conditioner inducing a predetermined large amplitude, high frequency non sine wave current ripple to said second electrode for creating a fluctuating voltage and fluctuating electrostatic field and maintaining continuous current flow through said gap without reversal of polarity.

10. The device of claim 9, wherein said first spark induction power conditioner is connectable in series between a high voltage power source and a positive plate electrode of a physical separator to attract negatively charged particulate materials to a positive plate electrode.

11. The device of claim 9, wherein said first spark induction power conditioner is connectable in series between a high voltage power source and a negative plate electrode to attract positively charged particulate materials to a negative plate electrode.

12. The device of claim 9, wherein said first spark induction power conditioner is connectable in series between a high voltage power source and a grounded plate electrode of a physical separator.

13. The device of claim 9, further comprising:

a second spark induction power conditioner spaced from said first spark induction power conditioner and including a third electrode connectable to a high voltage D.C. power source; and a fourth electrode spaced from said third electrode and forming another discharging gap therebetween, said fourth electrode being connectable to another plate electrode of a physical separator, at least one of said third and fourth electrodes being selectively positionable for altering spatial distance between said electrodes;

said power conditioner inducing a predetermined large amplitude, high frequency non sine wave current ripple to said fourth electrode for creating a fluctuating voltage and fluctuating electrostatic field and maintaining continuous current flow through said gap without reversal of polarity.

14. The device of claim 13, wherein one of said first and second spark induction power conditioners is connectable in series between a high voltage power source and a positive plate electrode of a physical separator and another one of said first and second spark induction power conditioners is connectable in series between a high voltage power source and a negative plate electrode of a physical separator, said fluctuating voltage fields associated with said first and second spark induction conditioners being independently adjustable and not in phase.

15. The device of claim 13, wherein said first and second spark induction power conditioners are connectable in series between a high voltage power source and a plurality of positive plate electrodes of a physical separator respectively.

16. The device of claim 13, wherein said first and second spark induction power conditioners are connectable in series between a high voltage power source and a plurality of negative plate electrodes of a physical separator respectively.

17. The device of claim 9, wherein said first spark induction power conditioner is connectable in series between a high voltage power source and a plurality of positive plate electrodes of a physical separator.

18. The device of claim 9, wherein said first spark induction power conditioner is connectable in series between a high voltage power source and a plurality of negative plate electrodes of a physical separator.

19. The device of claim 9, wherein said first spark induction power conditioner is connectable in series between a high voltage power source and a curved plate electrode of a physical separator.

20. The device of claim 13, wherein said second spark induction power conditioner further comprises:

a base having a channel formed therein and for housing said first and second electrodes;

a cover removably attachable to said base; and a plurality of fastening members selectively engageable with said third and fourth electrodes and for maintaining same at selected stable positions.

21. A physical separator for separating mixtures of particulate materials, said separator comprising:

an electrode assembly; and a D.C. voltage altering device attachable between a high voltage D.C. power source and said separator for improving separation efficiency thereof, said device including a spark induction power conditioner having a first electrode connectable to a high voltage D.C. power source; and a second electrode spaced from said first electrode and forming a discharging gap therebetween, said second electrode being connectable to a predetermined section of said separator, at least one of said electrodes being selectively positionable for altering spatial distance between said electrodes;

said power conditioner inducing a predetermined large amplitude, high frequency current ripple to said second electrode for creating a fluctuating voltage and fluctuating electrostatic field and maintaining continuous current flow through said gap without reversal of polarity.

22. The separator of claim 21, wherein said first spark induction power conditioner is connectable in series between a high voltage power source and a corona wire electrode of said separator to pin non-conducting particulate materials on a movable surface.

23. The separator of claim 21, wherein said first spark induction power conditioner is connectable in series between a high voltage power source and a static lifting electrode of said separator to lift conducting particulate materials from a movable surface.

24. The separator of claim 21, wherein said first spark induction power conditioner is connectable in series between a high voltage power source and a corona wire electrode of said separator that is connected in series with a static lifting electrode of said separator to separate non-conducting particulate materials from conducting particulate materials.

25. The separator of claim 21, further comprising:

a second spark induction power conditioner spaced from said first spark induction power conditioner and including a third electrode connectable to a high voltage D.C. power source; and a fourth electrode spaced from said third electrode and forming a discharging gap therebetween, said fourth electrode being connectable to another predetermined section of said separator, at least one of said third and fourth electrodes being selectively positionable for altering spatial distance between said third and fourth electrodes;

said second power conditioner inducing a predetermined large amplitude, high frequency current ripple to said fourth electrode for creating a fluctuating voltage and fluctuating electrostatic field and maintaining continuous current flow through said gap without reversal of polarity.

26. The separator of claim 25, wherein one of said first and second spark induction power conditioners is connectable in series between a high voltage power source and a corona wire electrode of said separator and another one of said first and second spark induction power conditioners is connectable in series between a high voltage power source and a static lifting electrode of said separator, said fluctuating voltage fields associated with said first and second spark induction conditioners being independently adjustable and not in phase.

27. The separator of claim 25, wherein said second spark induction power conditioner further comprises:

a base having a channel formed therein and for housing said first and second electrodes;

a cover removably attachable to said base; and a plurality of fastening members selectively engageable with said third and fourth electrodes and for maintaining same at selected stable positions.

28. The separator of claim 21, wherein said first spark induction power conditioner further comprises:

a base having a channel formed therein and for housing said first and second electrodes;

a cover removably attachable to said base; and a plurality of fastening members being selectively engageable with said first and second electrodes and for maintaining same at selected stable positions.

29. a physical separator for separating mixtures of particulate materials, said separator comprising:

an electrode assembly; and a D.C. voltage altenng device attachable between a high voltage D.C. power source and said separator for improving separation efficiency thereof, said device including a spark induction power conditioner having a first electrode connectable to a high voltage D.C. power source; and a second electrode spaced from said first electrode and forming a discharging gap therebetween, said second electrode being connectable to a predetermined section of said separator, at least one of said electrodes being selectively positionable for altering spatial distance between said electrodes and adjusting said discharging gap;

said power conditioner inducing a predetermined large amplitude, high frequency non-sine wave current ripple to said second electrode for creating a fluctuating voltage and fluctuating electrostatic field and maintaining continuous current flow through said gap without reversal of polarity.

30. The separator of claim 28, wherein said first spark induction power conditioner is connectable in series between a high voltage power source and a positive plate electrode of a physical separator to attract negatively charged particulate materials to a positive plate electrode.

31. The separator of claim 28, wherein said first spark induction power conditioner is connectable in series between a high voltage power source and a negative plate electrode to attract positively charged particulate materials to a negative plate electrode.

32. The separator of claim 28, wherein said first spark induction power conditioner is connectable in series between a high voltage power source and a grounded plate electrode of said separator.

* * * * *